US006942110B2

(12) United States Patent
Martins

(10) Patent No.: US 6,942,110 B2
(45) Date of Patent: Sep. 13, 2005

(54) POINT OF PURCHASE DISPLAY

(76) Inventor: Rick Martins, 5 Ruby Ct., Succasunna, NJ (US) 07876

( * ) Notice: Subject to any disclaimer, the term of this patent is extended or adjusted under 35 U.S.C. 154(b) by 41 days.

(21) Appl. No.: 10/609,028

(22) Filed: Jun. 27, 2003

(65) Prior Publication Data

US 2004/0262246 A1 Dec. 30, 2004

(51) Int. Cl.[7] ..... B42F 1/00
(52) U.S. Cl. ..... 211/59.1
(58) Field of Search ..... 211/59.1, 57.1, 211/72, 181.1, 85.2, 73; 248/220.31, 220.41, 220.42, 220.43

(56) References Cited

U.S. PATENT DOCUMENTS 5,620,104 A * 4/1997 Maglione ..... 211/59.1
6,119,875 A * 9/2000 Smith ..... 211/59.1
6,206,212 B1 * 3/2001 Loew ..... 211/189
6,378,710 B1 * 4/2002 Grueneberg ..... 211/132.1
6,675,978 B2 * 1/2004 Shea ..... 211/59.1
6,702,126 B2 * 3/2004 Park ..... 211/59.1

* cited by examiner

*Primary Examiner*—Jennifer E. Novosad
(74) *Attorney, Agent, or Firm*—Walter J. Tencza, Jr.

(57) ABSTRACT

An apparatus for displaying merchandise including a first U-shaped member comprised of an outer portion and an inner portion wherein the outer portion and the inner portion are substantially parallel to each other and the outer portion has a first slot. A second similar U-shaped member. A pegboard may be attached to the first U-shaped member and the second U-shaped member. The apparatus may include a top member and a bottom member having first ends connected to the first U-shaped member and second ends connected to the second U-shaped member. The top member may have an edge and there may be one or more slots located through the edge.

14 Claims, 7 Drawing Sheets

POINT OF PURCHASE DISPLAY

FIELD OF THE INVENTION

This invention relates to improved methods and apparatus concerning point of purchase displays.

BACKGROUND OF THE INVENTION

Various techniques are known for providing point of purchase displays.

SUMMARY OF THE INVENTION

The present invention in one or more embodiments includes an apparatus and a method of producing a point of purchase display. The method includes producing the point of purchase display by a new injection molding technique.

In one embodiment of the present invention an apparatus is provided including a first U-shaped member comprised of an outer portion and an inner portion wherein the outer portion and the inner portion are substantially parallel to each other and the outer portion has a first slot. A second similar U-shaped member may be provided comprised of an outer portion and an inner portion wherein the outer portion and the inner portion are substantially parallel; and the outer portion has a second slot. A pegboard may be attached to the inner portion of the first U-shaped member and the inner portion of the second U-shaped member.

The outer portions of the first and/or second U-shaped members may have a plurality of further slots. The apparatus may include a top member having a first end connected to the first U-shaped member and a second end connected to the second U-shaped member. The top member may have an edge and there may be one or more slots located through the edge. A bottom member may also be provided, having a first end connected to the first U-shaped member and a second end connected to the second U-shaped member. The apparatus may include a wire fixture on which the first and second U-shaped members may be hung. The wire fixture may be comprised of a plurality of U-shaped brackets.

The first and second U-shaped members may enclose first and second gaps. Each of the plurality of U-shaped brackets may have a first portion, a second portion, and a third portion which are connected together. The first portion and the third portion may be substantially parallel to each other and substantially perpendicular to the second portion. The first portion and the third portion of the plurality of U-shaped brackets can fit within the first and second gaps, respectively, of the first and second U-shaped brackets.

The present invention in one embodiment may be comprised of a method comprising the steps of using a molding process to form a first U-shaped member comprised of an outer portion and an inner portion wherein the outer portion and the inner portion are substantially parallel and the outer portion has a first slot. The method may also be comprised of using a molding process to form a similar second U-shaped member, to form a pegboard hole matrix, bottom member and top member. The first U-shaped member, second U-shaped member, bottom member, and top member may formed by molding an integral single unit.

The utilization of a production method in accordance with an embodiment of the present invention allows a significant freedom of the architecture of the polymer employed. I.E. "T-Walls" for spacers and structural reinforcement (see 80 on FIG. 1B) and "shut-Offs" for any holes or openings desired (see 40 & 15*a* on FIG. 1A) both not possible with the previously employed production method of vacuum forming.

DETAILED DESCRIPTION OF THE DRAWINGS

Figure 1A:
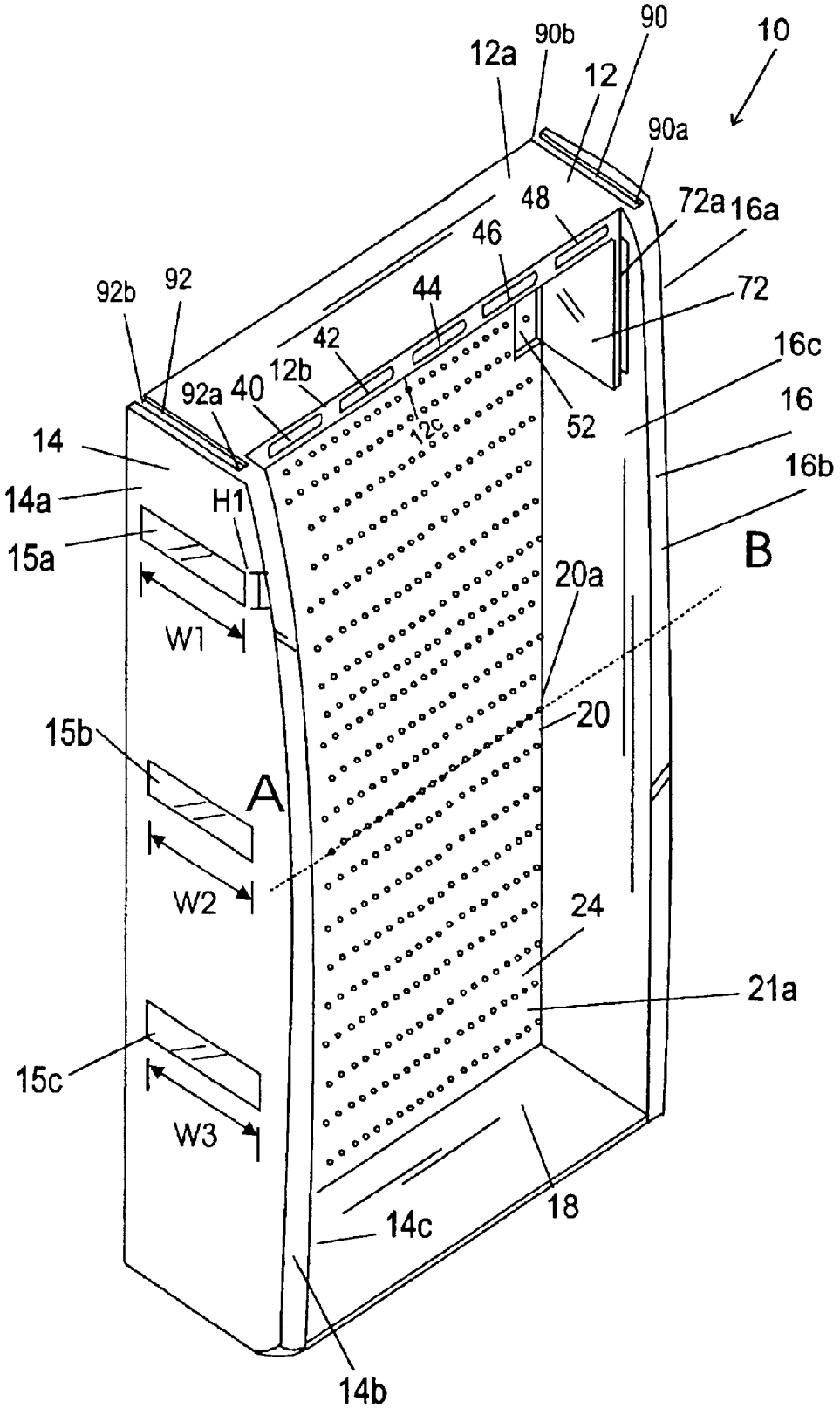
FIG. 1A shows a perspective view, which includes at least a portion of the front side of an apparatus in accordance with an embodiment of the present invention.
Figure 1B:
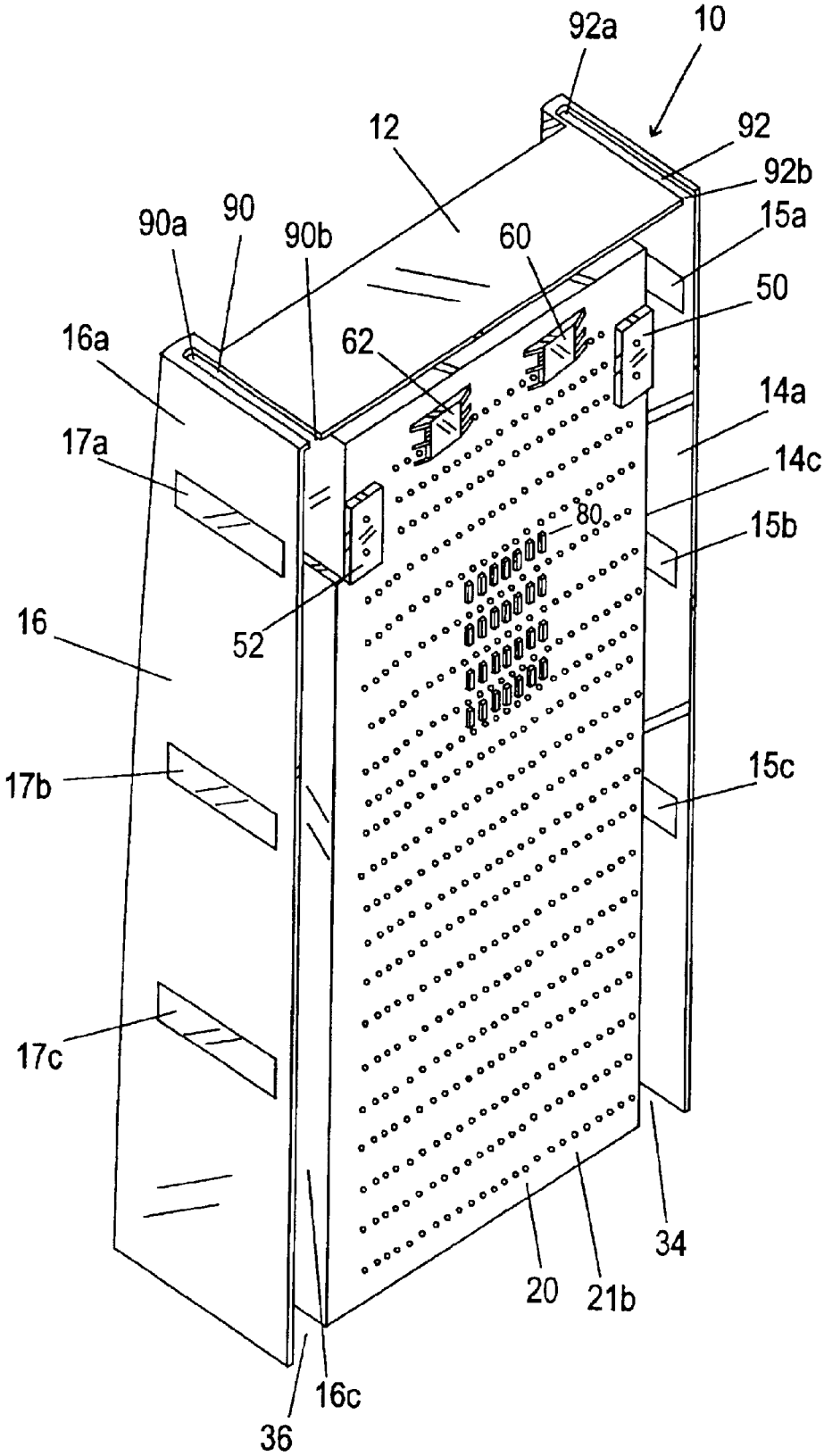
FIG. 1B shows a perspective view which includes at least a portion of the back side of the apparatus of FIG. 1A.
Figure 2:
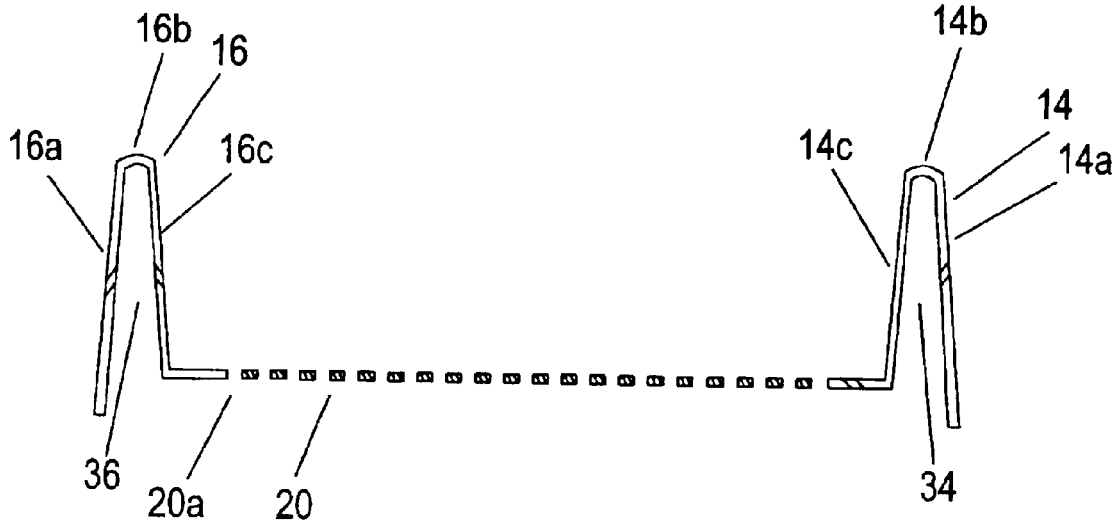
FIG. 2 shows a cross sectional view of the apparatus of FIG. 1A.
Figure 3:
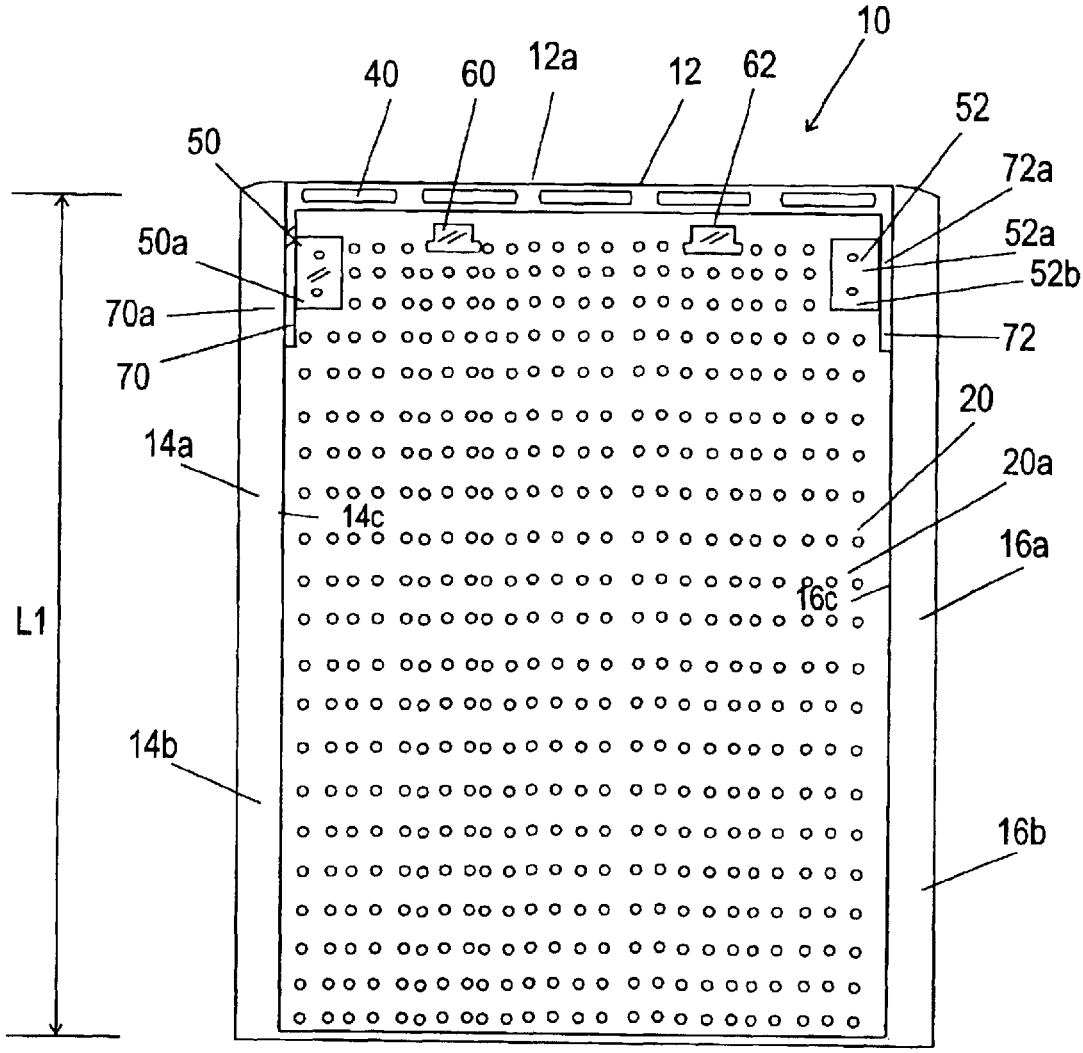
FIG. 3 shows a front view of the apparatus of FIG. 1A.
Figure 4:
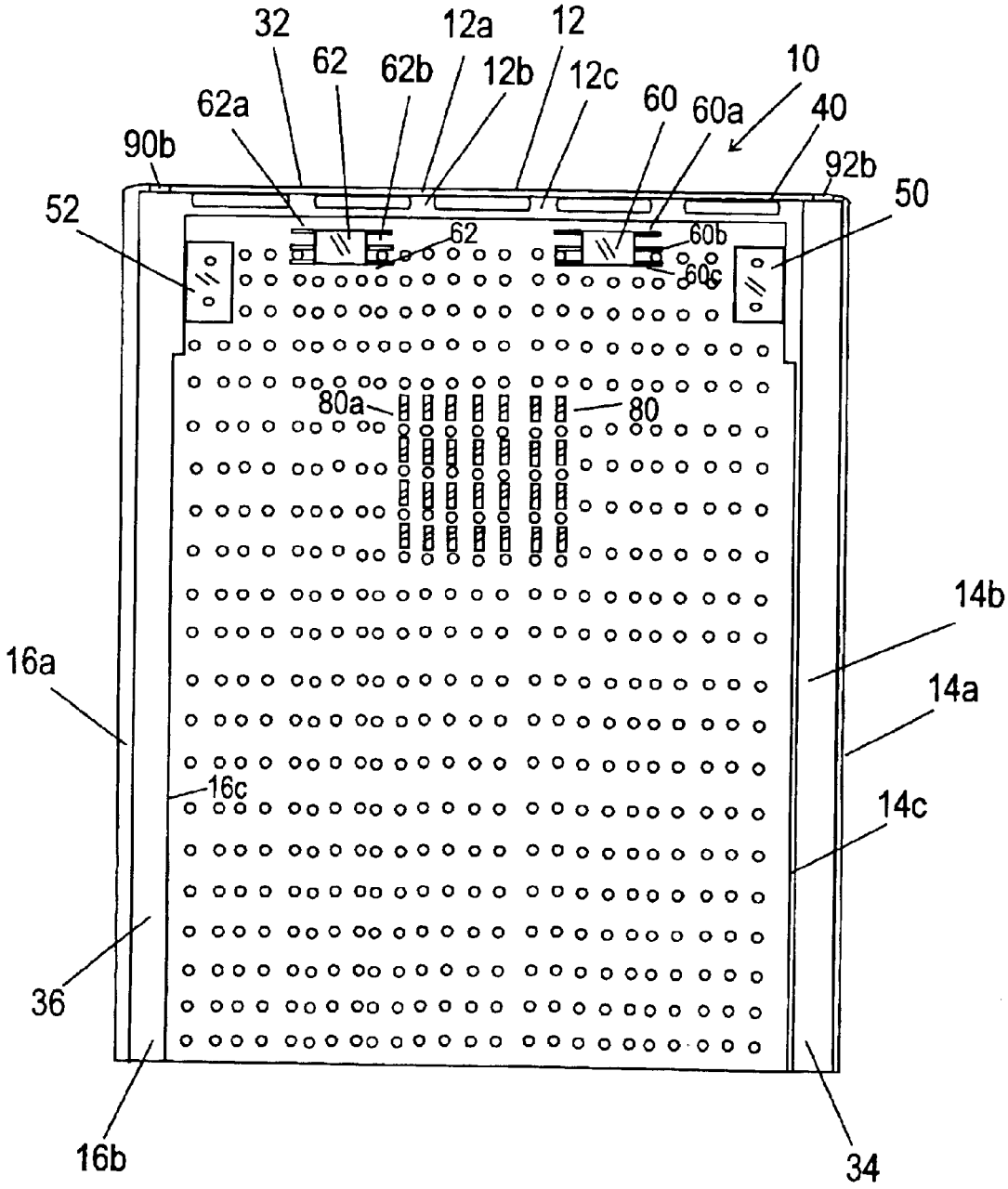
FIG. 4 shows a back view of the apparatus of FIG. 1A.

FIG. 1A shows a perspective view, which includes at least a portion of the front side of an apparatus 10 in accordance with an embodiment of the present invention. FIG. 1B shows a perspective view which includes at least a portion of the back side of the apparatus 10. FIG. 2 shows a cross sectional view of the apparatus 10 taken along a line AB. FIG. 3 shows a front view of the apparatus 10. FIG. 4 shows a back view of the apparatus 10.

The apparatus 10, which may be called a power wing or power wing display may be used for displaying retail items in a store. The apparatus 10 may be comprised of a top member 12, side members 14 and 16, and a bottom member 18. The apparatus 10 may also be comprised of perforated board 20 which is attached to the members 12, 14, 16, and 18 as shown by FIGS. 1A and 1B. The perforated board 20 may be comprised of a plurality of holes such as hole 20*a*. The perforated board may have a front surface 21*a* shown in FIG. 1A and a rear surface 21*b* shown in FIG. 1B.

The top member 12 is fixed to the side members 14 and 16. Referring to FIG. 2, each of the side members, 14 and 16 have a U-shape with a spaces, openings, or gaps 34 and 36, respectively. The side member 14 is comprised of outer portion 14*a*, edge portion 14*b*, and inner portion 14*c*. The gap 34 is between the outer surface 14*a* and the inner surface 14*c*. The side member 16 is comprised of outer surface or portion 16*a*, edge portion 16*b*, and inner portion 16*c*. The gap 36 is between the outer portion 16*a* and the inner portion 16*c*. The bottom member 18 is fixed to the side members 14 and 16. The perforated board 20 may be attached to the members 12, 14, 16, and 18 by virtue of an number of molding processes including injection molding.

The top member 12 is also U-shaped and includes an outer portion 12*a*, an edge 12*b*, and an inner portion 12*c*. There is a gap 32 between the outer portion 12*a* and the inner portion 12*c*. The edge 12*b* has openings or slots 40, 42, 44, 46, and 48. The slots 40, 42, 44, 46, and 48 are used to attach graphic panels and product glourifiers. The slots 40, 42, 44, 46, and 48 are created automatically as a result of shut-offs where the two mold halves meet to also strengthen the mold components from warping and bowing under the pressures of the molding process.

The top member 12 also has slots 90 and 92 shown in FIG. 1A. Slot 90 has an open end 90*b* and a closed end 90*a*. Slot 92 has an open end 92*b* and a closed end 92*a*.

The side members 14 and 16 are mirror images of each other and therefore only side member 14 needs to be described in further detail. Side member 14 includes "Side Burn Slots" or openings 15*a*, 15*b*, and 15*c*. Slot 15*a* may have a width of five and three eighths inches, slot 15*b* may have a width of six inches, and slot 15*c* may have a width of six and five sixteenths inches. The member 14 typically increases in width from a portion near the top member 12 to a portion near the bottom member 18. This being purely an aesthetic detail that has no bearing on the performance of this concept, however a modification to the shape will effect the size of the "Side Burn Slots". Slot 15*c* is typically wider than slot 15*b*, which is typically larger than slot 15*a*. The slots 15*a*, 15*b*, and 15*c*, each typically have a height of H1 which may be one inch. The slots 15*a*, 15*b*, and 15*c* lead into the gap 34, so that an object can be inserted through any of the slots 15*a*, 15*b*, and 15*c*, into the gap 34. The member 16 typically has slots 17*a*, 17*b*, and 17*c*, analogous to slots 15*a*, 15*b*, and 15*c*, located through outer portion 16*a* as shown in FIG. 1B. An object can be inserted into any of the slots of the member 16 and into the gap 36.

The side burn slots 15*a*, 15*b*, 15*c*, and analogous slots 17*a*, 17*b*, and 17*c* in outer portion 16*a*, may be created by an injection molding process with the shut off technique and are used to hold additional product glourifiers merchandisers and or graphics.

The apparatus 10 further includes portion 50 which has holes 50*a* and 50*b* and portion 52 which has holes 52*a* and 52*b*. The purpose of portions 50 and 52 is to make available an area onto which an adaptor can be mechanically fastened to attach apparatus 10 to a new fixture not yet prior art. The portions 50 and 52 appear as indentations in the front view of FIG. 3 but appear as protrusions in the perspective view of FIG. 1B and in the back view of FIG. 4. The apparatus 10 further includes portions 60 and 62 which allow for any stock components to be employed in the attachment of apparatus 10 to fixture 100 or a multitude of other fixtures. The portions 60 and 62 appear as indentations in the front view of FIG. 3 but as protrusions in the perspective view of FIG. 1B and in the back view of FIG. 4. The portion 60 includes portions 60*a*, 60*b*, and 60*c* which are "T" walls and serve to reinforce the load bearing capabilities of portions 60 and 62. The portion 62 includes portions 62*a*, 62*b*, and 62*c* which are "T" walls and serve to reinforce the load bearing capabilities of portions 60 and 62. The apparatus 10 also includes a plurality of rectangular protrusions 80, such as 80*a*, shown in FIG. 4, which increase the wall thickness of portion 20 up to a common thickness, needed for most conventional peg hooks to hang without dropping downward. Also, portions 80 and 80*a* are "T" walls that serve to strengthen portion 20 from weigh related deflection; under the load of the hooked product; such as a "D" sized batteries.

The length, L1 shown in FIG. 3, of the apparatus 10 may be two to four feet in length. The apparatus 10 can be removed from a shipping box and simply hung over the wire fixture in the store. The production method employed allows for a completely assembled unit to be created from one part. Unlike the prior art, this concept simply allows for an unparalleled modification of the chosen environment, with the most simplistic utilization endeavor and the most cost effective or efficient method of production.

Figure 5:
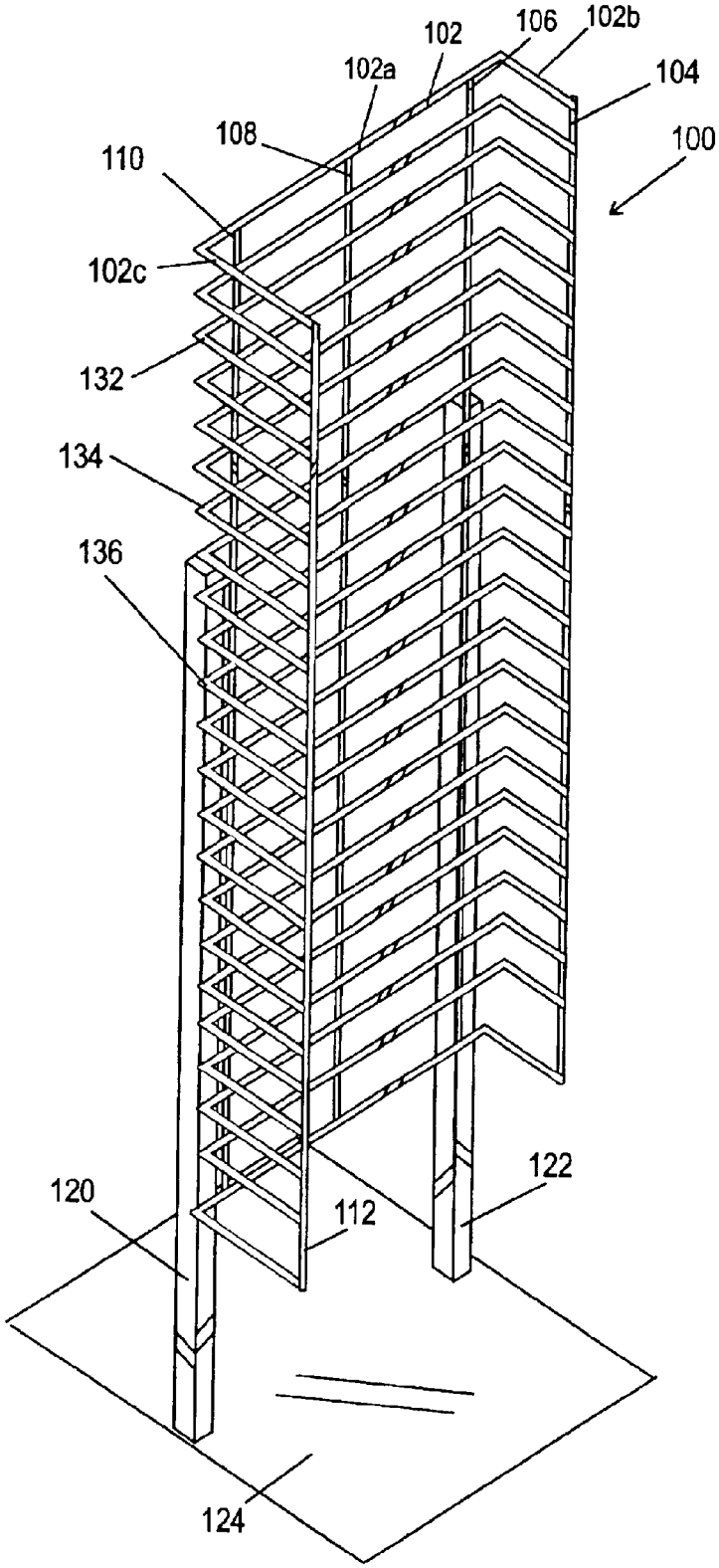
Fig. 5 (Prior Art)
FIG. 5 shows a perspective view of a wire fixture known in the prior art.

FIG. 5 shows a perspective view of a wire fixture 100 known in the prior art. The wire fixture 100 includes metal column rods 104, 106, 108, 110, and 112. The wire fixture 100 also includes a plurality of U-shaped brackets such as U-shaped bracket 102, each of which is connected, such as by welding to metal column rods 104, 106, 108, 110, and 112. U-shaped bracket 102 includes a portion 102*a* which is perpendicular to and integral with and/or connected to portions 102*b* and 102*c*. The other U-shaped brackets may be identical to U-shaped bracket 102 and may include U-shaped brackets 132, 134, and 136. The wire fixture 100 may be attached by welding, or hung on or mechanically attached onto, or attached in any other manner to upright metal poles or columns 120 and 122. The metal poles or columns 120 and 122 may be attached at one end to a metal base 12. It should also be known that wire fixture 100 can also be made from other materials other than wire and can be attached to a multitude of locations at the retail environment; not only pole stands. Also apparatus 10 can be employed in many of these additional environments.

Figure 6:
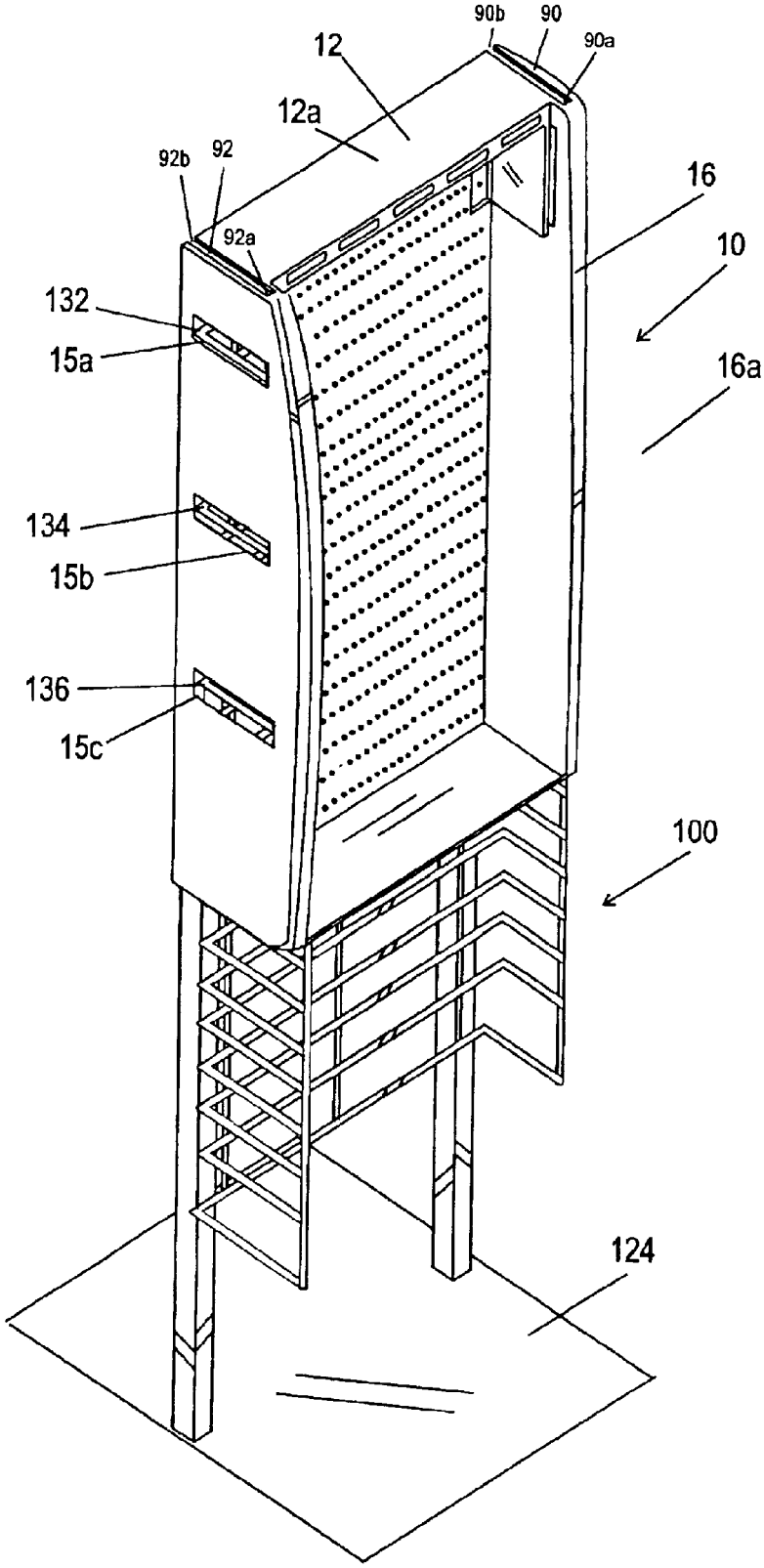
FIG. 6 shows a perspective view of the apparatus of FIG. 1A hung on the wire fixture of FIG. 5.

FIG. 6 shows a perspective view of the apparatus 10 of FIGS. 1A-4 hung on the wire fixture 100 of FIG. 5. The portions of the U-shaped brackets of the wire fixture 100, such as portions 102*c* and portions of other U-shaped brackets similar to portion 102*c* are inserted into the gap 34 between the portions 14*a* and 14*c* of the U-shaped member 14. The portions of the U-shaped brackets of the wire fixture 100, such as portions 102*b* and portions of other U-shaped brackets similar to portion 102*b* are inserted into the gap 36 between the portions 16*a* and 16*c* of the apparatus 100. The apparatus 100 rests on the wire fixture 100, so that an inner surface of the portion 12*a* of the member 12 rests on the U-shaped bracket 102. One or more U-shaped brackets can be seen through the slots 15*a*, 15*b*, and 15*c*, as shown by FIG. 6 and would be able to seen through the analogous slots in portion 16*a*. For example, bracket 132 can be seen through slot 15*a*, bracket 134 can be seen through slot 15*b*, and bracket 136 can be seen through slot 15*c*.

The apparatus 10 may be made as a single piece unit by injection molding. An injection molding production method can be used which employs molten polymer forced, with tons of pressure, into a metal mold. This mold may be comprised of two halves that when put together create a cavity of the same design as the part. It is into this cavity that the molten polymer (plastic) is forced in while hot and then cooled into a ridged form. This part is then ejected from the two mold halves once they are opened up. A design technique called "Draft" (prior art) can be utilized to ensure that the part can, indeed, be ejected from the mold, intact.

"Injection Molding," allows for a "T-Wall" feature to be incorporated into this design for free, with no labor required for its assembly. The "T-Wall" offers reinforcements to any points of contact with store related objects; such as wire fixtures, such as fixture 100. (see portions 80, 80*a*, 62, 62*a*, 62*b*, 60, 60*a*, and 60*b*). This is a positive feature when holding allot of weight in this apparatus 10; without the need for a extra metal bracket.

"Injection Molding" also allows for "Shut-Offs." This feature is where the two mold halves touch, therefore shutting off the flow of the molten polymer in a desired area. This allows for all the, hundreds, of peg wire holes, such as hole 20*a* in the pegboard-like portion 20 to be in the part, i.e. apparatus 10 prior to being ejected from the open mold halves. "Shut-Offs" also allow for the long thin "Vertical Thru Slots" 72A, 70 and "Speed Slots" 40, 42, 44, 46, and 48 on the edge 12*b* that can except the "Riser" paper board panel and quick snap-on riser treatments in the future. They also make possible a thinner space between the double walls, i.e. outer portion 12 and inner portion 12*c* for top member or top overhang 12 on the apparatus 10 while still employing the injection molding production method.

The "side burn slots", such as slots 15*a–c* and 17*a–c* are the product of "shut offs" and offer a unique ability to hang more merchandise on the side of the apparatus 10. If desired the slots 15*a–c* and/or slots 17*a–c* can be covered by a large graphic panel.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a first U-shaped member comprised of an outer portion, an edge portion, and an inner portion wherein the outer portion and the inner portion are substantially parallel, the edge portion is substantially perpendicular to the outer portion and the inner portion, and the edge portion connects the outer portion to the inner portion, and the outer portion has a first slot, wherein an object can be inserted through the first slot;

a second U-shaped member comprised of an outer portion, an edge portion, and an inner portion wherein the outer portion and the inner portion are substantially parallel, the edge portion is substantially perpendicular to the outer portion and the inner portion, and the edge portion connects the outer portion to the inner portion; and a perforated board integrated to the inner portion of the first U-shaped member and the inner portion of the second U-shaped member;

and wherein the perforated board is substantially perpendicular to the inner portion of the first U-shaped member and the inner portion of the second U-shaped member.

2. The apparatus of claim 1 wherein the outer portion of the second U-shaped member has a second slot, wherein an object can be inserted through the first slot.

3. The apparatus of claim 1 further comprising a top member having a first end connected to the first U-shaped member and a second end connected to the second U-shaped member.

4. The apparatus of claim 3 wherein the top member has an edge and there is a second slot through the edge;

and wherein an object can be inserted through the first slot.

5. The apparatus of claim 3 further comprising a bottom member having a first end connected to the first U-shaped member and a second end connected to the second U-shaped member.

6. The apparatus of claim 5 wherein the top member and the bottom member are substantially perpendicular to the perforated board.

7. The apparatus of claim 5 wherein the bottom member, top member, inner portion of the first U-shaped member, the inner portion of the second U-shaped member, and the perforated board form an open box;

wherein the open box has four sides and a base and wherein the bottom member, top member, inner portion of the first U-shaped member, and the inner portion of the second U-shaped member each form one of the four sides of the open box;

and wherein the perforated board forms the base of the open box.

8. The apparatus of claim 7 wherein the apparatus is made as a single piece unit by injection molding.

9. The apparatus of claim 3 wherein the top member is substantially perpendicular to the perforated board.

10. The apparatus of claim 1 further comprising a bottom member having a first end connected to the first U-shaped member and a second end connected to the second U-shaped member.

11. The apparatus of claim 10 wherein the bottom member is substantially perpendicular to the perforated board.

12. The apparatus of claim 1 wherein the outer portion of the first U-shaped member has a second slot; and wherein an object can be inserted through the second slot.

13. The apparatus of claim 1 further comprising a a wire fixture comprised of a plurality of U-shaped brackets, wherein there is a first gap between the inner portion of the first U-shaped member and the outer portion of the first U-shaped member;

wherein there is a second gap between the inner portion of the second U-shaped member and the outer portion of the second U-shaped member;

wherein each of the plurality of U-shaped brackets has a first portion, a second portion, and a third portion which are connected together and wherein the first portion and the third portion are substantially parallel to each other and substantially perpendicular to the second portion;

and wherein the first portion and the third portion of the plurality of U-shaped brackets are adapted to fit within the first and second gaps, respectively.

14. An apparatus comprising:

a first U-shaped member comprised of an outer portion, an edge portion, and an inner portion wherein the outer portion and the inner portion are substantially parallel, the edge portion is substantially perpendicular to the outer portion and the inner portion, and the edge portion connects the outer portion to the inner portion;

a second U-shaped member comprised of an outer portion, an edge portion, and an inner portion wherein the outer portion and the inner portion are substantially parallel, the edge portion is substantially perpendicular to the outer portion and the inner portion, and the edge portion connects the outer portion to the inner portion; and a perforated board integrated to the inner portion of the first U-shaped member and the inner portion of the second U-shaped member;

and wherein the perforated board is substantially perpendicular to the inner portion of the first U-shaped member and the inner portion of the second U-shaped member; and further comprising a top member having a first end connected to the first U-shaped member and a second end connected to the second U-shaped member; and a bottom member having a first end connected to the first U-shaped member and a second end connected to the second U-shaped member; and wherein the bottom member, top member, inner portion of the first U-shaped member, the inner portion of the second U-shaped member, and the perforated board form an open box;

wherein the open box has four sides and a base and wherein the bottom member, top member, inner portion of the first U-shaped member, and the inner portion of the second U-shaped member each form one of the four sides of the open box;

and wherein the perforated board forms the base of the open box.

* * * * *